US006758942B2

(12) United States Patent
Naddeo

(10) Patent No.: US 6,758,942 B2
(45) Date of Patent: Jul. 6, 2004

(54) PROCESS FOR BLEACHING PULP OR PAPER

(75) Inventor: Ronald C. Naddeo, Kempton, PA (US)

(73) Assignee: Royce Associates, East Rutherford, NJ (US)

( * ) Notice: Subject to any disclaimer, the term of this patent is extended or adjusted under 35 U.S.C. 154(b) by 336 days.

(21) Appl. No.: 10/078,095

(22) Filed: Feb. 15, 2002

(65) Prior Publication Data

US 2003/0155085 A1 Aug. 21, 2003

(51) Int. Cl.[7] ..... D21C 9/10
(52) U.S. Cl. ..... 162/82; 162/83; 162/84
(58) Field of Search ..... 162/5, 6, 82, 83, 162/84; 8/110

(56) References Cited

U.S. PATENT DOCUMENTS

| | | | | |
|---|---|---|---|---|
| 4,113,427 A | | 9/1978 | Fono et al. | |
| 4,166,717 A | | 9/1979 | Fono et al. | |
| 4,398,914 A | | 8/1983 | Blum et al. | |
| 4,676,961 A | | 6/1987 | Appl et al. | |
| 4,866,190 A | | 9/1989 | Tordeux et al. | |
| 4,961,752 A | | 10/1990 | Arifoglu et al. | |
| 5,017,194 A | | 5/1991 | Arifoglu et al. | |
| 5,084,066 A | | 1/1992 | Arifoglu et al. | |
| 5,103,522 A | | 4/1992 | Arifoglu et al. | |
| 5,196,260 A | | 3/1993 | Dirschl et al. | |
| 5,264,001 A | | 11/1993 | Arifoglu et al. | |
| 5,464,501 A | * | 11/1995 | Kogan et al. | 162/6 |
| 5,549,715 A | | 8/1996 | Olip | |
| 5,560,805 A | * | 10/1996 | Hamilton et al. | 162/5 |
| 5,733,412 A | * | 3/1998 | Markham et al. | 162/6 |
| 5,749,923 A | | 5/1998 | Olip et al. | |
| 6,153,300 A | * | 11/2000 | Stromberg et al. | 428/393 |
| 6,211,400 B1 | * | 4/2001 | Berghofer et al. | 560/150 |
| 6,428,653 B1 | * | 8/2002 | Denton et al. | 162/24 |

FOREIGN PATENT DOCUMENTS

| | | |
|---|---|---|
| CA | 2128814 | 1/1995 |
| JP | S53-29722 | 8/1978 |
| JP | 78029722 | 8/1978 |
| SU | 1414901 | 8/1988 |
| SU | 1560663 | 4/1990 |

* cited by examiner

*Primary Examiner*—Peter Chin
(74) *Attorney, Agent, or Firm*—William A. Simons; Wiggin and Dana LLP

(57) ABSTRACT

A process for bleaching substantially lignin-free pulp or paper in a single-stage bleaching process or multi-stage bleaching process; comprising contacting said substantially lignin-free pulp or paper with an aqueous reductive bleaching solution comprising hydroxymethane sulfinic acid during a reductive bleaching stage for sufficient amount of time to at least partially bleach said substantially lignin-free pulp or paper.

13 Claims, No Drawings

PROCESS FOR BLEACHING PULP OR PAPER

BACKGROUND OF THE INVENTION

1. Field of the Invention

The present invention relates to a process for bleaching substantially lignin-free pulp or paper using an aqueous bleaching solution containing hydroxymethane sulfinic acid (HAS). In particular, this invention relates to a process for bleaching substantially lignin-free pulp or paper using an aqueous bleaching solution containing HAS alone or with either additional reductive bleaches or with bleaching initiators or both.

2. Brief Description of Art

In the last decade or so, recycled mixed waste paper has been increasingly used as a source for printing and writing paper and other commonly used paper materials. In fact the mixed waste paper termed as "mixed office waste" or "office pack" was not used before the 1990's and is one of the primary raw materials defined as substantially lignin-free pulp. Generally, this recycled mixed waste paper is substantially lignin-free and contains inks and dyes that need to be removed. Such waste papers have been treated with a reductive bleaching agent such as sodium hydrosulfite (also known as hydro) or formamidine sulfinic acid (also known as FAS) to both bleach the waste paper and color-strip out of the dyes. However, each of these bleaching agents have significant operating problems associated with them. Hydro and FAS have flammability or spontaneous combustion problems and require separate storage areas. They also will decompose readily and thus have a short shelf life and are difficult to store for long periods of time. Furthermore, hydro can be shipped in aqueous solutions that have concentrations of no greater than 15% by weight. It has to be used soon after being made or it will decompose. Thus, it is desirable to use hydro at locations close to where it is made so as to avoid excess shipping costs due to water and loss of product due to decomposition. FAS cannot be dissolved in water in concentrations greater than 3% in solution, which makes it commercially unacceptable. When using FAS as an unstable powder, it is detrimental since it is a health hazard due to residual thiourea. Since both hydro and FAS are safety concerns, unstable in water and they react quickly with air and other entrained reducible chemicals (i.e. metals), their use to bleach and color-strip mixed waste paper fibers is greatly hindered. They are commonly used in short stages because of their rapid reaction. But in many instances mills have no choice but to use High Density Storage towers which have several hours retention which causes problems in reversion of the pulp or paper product since the current commercial bleaches are consumed in minutes. Accordingly, there is a need to find an improved process for bleaching and color-stripping mixed recycled paper and pulp as well as other substantially lignin-free papers and pulp.

Separately, hydroxymethane sulfinic acid (also known as HAS) has been proposed as a reductive chemical for textiles and mechanical or ground wood pulp and papers.

Several references discuss these various potential uses for hydroxymethane sulfinic acid:

Japanese Patent No. 78029722 teaches first bleaching unbleached or partially bleached wood pulp or lignified mechanical pulp or used paper with a two-stage bleaching process of hydrogen peroxide and then Rongalite (Hydroxymethane Sulfinic Acid).

Soviet Union Published Patent Application No. 1414901 describes joint bleaching of pulp and wood pulp (i.e. mechanical fully lignified pulp) using sodium hydrosulfite or Rongalite.

Soviet Union Published Patent Application No. 1560663 describes bleaching of wood pulp (i.e. mechanical fully lignified pulp) using a mixture of trisodium phosphate, Rongalite and sodium hydrosulfite.

Canadian Patent Application No. 2,128,814 teaches adding a treating agent (e.g. sodium hydrosulfite, formamidine sulfinic acid (FAS) or sodium formaldehyde sulfoxylate to kraft pulp during a final stage to increase the strength of the final paper product.

U.S. Pat. No. 4,113,427 (Fono et al.) describes a process for dying cellulosic textiles with vat and sulfur dyes using a reducing agent composition that contains 85–99% by weight sodium dithionite (also known as sodium hydrosulfite or hydro) and 1–15% sodium hydroxymethane sulfinate.

U.S. Pat. No. 4,166,717 (Fono et al.) describes a process for dying cellulosic textiles with indigo dye which includes first aging the dye solution for about 12 hours; then adding sodium dithionite and sodium hydroxide to the aged dye solution; then incorporating an aldehyde sulfoxylate addition product to stabilize the aged dye solution; and then immerging a cellulosic textile in the stabilized dye solution.

U.S. Pat. No. 4,676,961 (Appl et al.) teaches a stabilized water-containing solution dithionite formulation that contains certain amounts of sodium and/or potassium salts (e.g. sodium hydroxy methane sulfinate).

None of these references teach or suggest using an aqueous bleaching solution that contains HAS in the bleaching stage to bleach a substantially lignin-free pulp or paper.

BRIEF SUMMARY OF THE INVENTION

Therefore, one aspect of the present invention is directed to a process for bleaching recycled substantially lignin-free pulp or paper in either a single-stage bleaching process or a multi-stage bleaching process; comprising contacting said substantially lignin-free pulp or paper with an aqueous reductive bleaching solution comprising hydroxymethane sulfinic acid during a reductive bleaching stage for sufficient amount of time to at least partially bleach (and sometimes preferably fully bleached) said substantially lignin-free pulp or paper.

Another aspect of the present invention is directed to an aqueous reductive bleach solution comprising hydroxymethane sulfinic acid with at least one bleaching initiator.

It has been found that the use of HAS alone or in combination with one or more reductive bleaches such as hydro or FAS gives superior brightness over those other reductive bleaches used alone. Furthermore, HAS has the advantages that it will not rapidly decompose or ignite when used in wet or in extreme ambient conditions (e.g. a hot paper mill environment). HAS does not need to be stored in a separate section of the paper mill because it is not self-igniting or a flammable hazardous material. HAS can be stored as a powder or liquid for months without losing strength. HAS can be made into an aqueous solution having concentrations up to about 40%, thus making it better suited for commercial transportation and use. HAS will work better than hydro or FAS in processes that require long bleaching steps because it does not react as quickly with oxidants such as entrained air or decompose as rapidly in water. Also, it can increase the maximum bleach response or ceiling brightness while stabilizing the system when combined with other reductive bleaches. It can be used with a reductive initiator to obtain a further increased bleach response since it is more stable than hydro or FAS.

DETAILED DESCRIPTION OF THE INVENTION

The term "substantially lignin-free pulp or paper" as used in the present specification and claims is intended to mean any pulp or paper wherein the amount of lignin is less than or equal to about 10% by weight of the total solids in the pulp or paper. This is to include pulps where most of the lignin has been extracted. It excludes "mechanical" pulp (or paper made from that pulp) where the majority of lignin has not been extracted. The preferred substantially lignin-free pulp or paper contains less than about 5% by weight lignin and is recycled office or mixed waste paper. Other chemical pulps and papers including virgin paper pulps that meet the maximum lignin content could also be treated by the present invention.

The term "bleaching" as used in the present specification and claims is intended to mean any process that either bleaches or color-strips or does both to the substantially lignin-free pulp or paper. Bleaching processes normally refer to brighten the chromophoric nature of the pulp or paper fibers, whereas color-stripping processes normally refer to removing dyes or other extra color bodies from the pulp or paper mixture.

The terms "primary reductive bleaching step" and "primary aqueous reductive bleaching solution" as used herein refer to the first reductive bleaching step or stage which the substantially lignin-free pulp or paper is subjected to.

The term "hydroxymethane sulfinic acid" or "HAS" as used in the present specification or claims is used to mean either or both this acid or its salts. The preferred form is the sodium salt of HAS. This compound is also known by the chemical names: sodium hydroxymethane sulfinate or sodium methanalsulfoxylate. It is also identified by the trade name Rongalite.

In accordance with one preferred embodiment of the present invention, an aqueous solution of a substantially lignin-free pulp or paper such as recycled mixed waste paper is contacted with a reductive bleaching solution containing HAS alone or in combination with other reductive bleaching agents or with bleaching initiators or with both. This contacting preferably occurs during the first or primary bleaching step or stage. In some embodiments of the present invention, it may be desirable to use this bleaching solution in other reductive bleaching stages besides the first stage.

Preferably, the aqueous reductive bleaching solution contains about 0.1 to about 40 pounds, more preferably from about 1 to about 10 pounds of hydroxymethane sulfinic acid per ton (dry weight) of pulp or paper being treated.

This aqueous bleaching reductive solution may preferably contain, besides water and HAS, at least one other reductive bleaching agent. The preferred other bleaching agents are hydro or FAS or both. If either hydro or FAS or both is employed along with HAS, their preferred amounts are also about 0.1 to about 40 pounds per ton (dry weight) of pulp or paper being treated.

The aqueous reductive bleaching solution may also preferably contain, besides water and HAS, at least one bleaching initiator. The preferred bleaching initiators are alum and simple carbohydrates or sugars (preferably dextrose). If one or more bleaching initiators is employed along with HAS its preferred amounts are also about 0.1 to about 40 pounds, more preferably about 5 to about 40 pounds, per ton (dry weight) of pulp or paper being treated.

One preferred embodiment of the present invention is to employ an aqueous reductive bleaching solution containing a mixture of HAS and either hydro or FAS wherein the weight ratio of HAS to the total amount of other reductive bleaching agent(s) is from about 1:20 to about 20:1 by weight. This solution may be made from a HAS powder and either a hydro powder or FAS powder that are mixed together as powders and then added to water to produce the desired bleaching solution just before the bleaching step occurs. This ensures that the maximum bleaching effect will be realized in that bleaching step. Alternatively, an aqueous solution powder of HAS may be mixed with a powder or an aqueous solution of hydro or FAS and sufficient water to create the desired bleaching solution.

Another preferred embodiment of the present invention is to employ an aqueous reductive bleaching solution that contains a tri-mixture of HAS, hydro and FAS. Preferably the weight ratio of HAS to the combined weight of hydro and FAS is from about 1:20 to about 20:1. Again, this could be prepared by mixing either powders or aqueous solutions of the components together with sufficient water.

Still another preferred embodiment of the present invention is to employ a reductive aqueous bleaching solution that contains, besides water and HAS, at least one bleaching initiator such as alum or dextrose or both. Preferably, the weight ratio of HAS to total amount of bleaching initiator is from about 1:20 to about 20:1. This bleaching solution could be prepared from either mixing powders of aqueous solutions of the ingredients to either.

And one further preferred embodiment of the present invention is to employ an aqueous bleaching solution that contains HAS with both one or more bleaching agents (most preferably, hydro or FAS or both) and at least bleaching initiator (most preferably, alum or dextrose or both). Again, this bleaching solution could be made by mixing either powders or aqueous solutions of each component together with sufficient water to prepare the desired bleaching solution.

The contacting step of the present invention may be carried out under any conditions generally employed in a reductive bleaching step in a pulp or paper mill. Preferably, the contacting temperature is from about 50° C. to about 120° C.; more preferably about 70° C. to about 110° C. The contacting time is preferably from about one minute to about 540 minutes; more preferably from about 15 minutes to about 360 minutes. The pH of the bleaching solution is from about 4 to 12; more preferably from about 4 to 8 or from about 10 to about 11.

If an oxidative-reductive bleaching process is employed with the present invention, the oxidative bleaching steps and other reductive bleaching steps that do not employ HAS may be carried out according to any conventional matter.

The resulting bleached paper has several significant properties it has higher brightness, lower cost per ton to produce, less brightness reversion and lower color. All these properties were achieved while using a safer reductive bleach.

After the primary reductive bleaching step is completed, the bleached pulp or paper may be further processed as desired. Such further processing steps may include further treatments with an aqueous solution containing HAS alone or with other ingredients as described above.

The present invention is further described in detail by means of the following Examples and Comparisons. All parts and percentages are by weight and all temperatures are degrees Celsius unless explicitly stated otherwise.

EXAMPLES

For all the examples the dosage of bleach chemical was made into a 1% solution either from a powder or liquid concentrated solution and than added to 200 gms of a 10% pulp slurry via syringe to make up the proper dosage displayed below.

Example 1

Recycled pulp from a mixed office paper bale is taken and processed through a conventional pulping and deinking process for high brightness market pulp. The pulp is than bleached with HAS (Hydroxymethane Sulfinic acid) at 10lbs per ton of pulp simulating a Disperser and screw feeder for 5 minutes and than a retention vessel for 40 minutes at 98° C. The resulting pulp has a brightness of 85.4 brightness compared to a brightness of 83.6 produced by sodium hydrosulfite bleaching at the same conditions.

Example 2

A similar type of paper pulp and process as in Example 1 was used to look at combining HAS with sodium hydrosulfite and its effect on brightness. A series of bleaching experiments were run changing the ratio of HAS and Hydro from 1–9 parts. The purpose of the experiment was to find the most economical chemical combination which gives the highest brightness.

On this particular pulp at 10 lbs per ton of Hydrosulfite gave a 84.1 brightness. Using 4 lbs per ton of Hydrosulfite with 4 lbs of HAS (a 2 pound chemical use reduction) an 85.4 brightness was achieved at the same chemical cost. However even greater brightness synergy was seen at 2 lbs per ton of Hydro with 5 lbs of HAS which gave a final brightness of 86.2. That was a 2.1 brightness increase, a 3 lb per ton chemical reduction, and a 5% cost reduction. When HAS was run by itself, it was not as effective on this pulp yielding only a 84.3 brightness at a 5% increased cost.

Example 3

This process is similar but the pulp is from a different pulp mill location using a different low lignin recycled pulp and at 70° C. On this pulp a 78.2 brightness was achieved with 10 lbs per ton of Hydrosulfite. The best synergies of HAS and Hydrosulfite were seen at higher ratios of Hydrosulfite to HAS.

HAS could not produce a brightness above 78.2 by itself even at higher costs than Hydrosulfite. A 1:1 ratio blend of HAS and Hydro gave a brightness of 79.0, while a 2:3 ratio gave a brightness of 79.3 and a ratio of 3:7 gave brightness of 79.5. The 2:3 ratio produced a lower cost pulp than the 1:1, and the 3:7 was even lower in cost.

Example 4

Being interested in the hazards associated with combinations of HAS and Hydro and knowing that Hydro at a 60% concentration with an inert chemical like NaCl is considered to be a DOT 4.2 self beating hazard, a sample of a 2:3 ratio (HAS:Hydro or 40% HAS and 60% Hydro) to a DOT approved lab and had the sample tested for spontaneous self heating hazards. The material was found to be non-hazardous, showing another unique synergy of using HAS with Hydrosulfite.

Example 5

Keeping all of the above examples in mind, and at similar conditions, a combination of HAS, Alum, Dextrose (a pyrophoricly inert reductive initiator), and FAS was tested. FAS is known for superior color-stripping over Hydrosulfite, but it is also twice as expensive. So we used it as our base case on a mixed office waste pulp that was high in color. We analyzed brightness and b* color value (the higher the b* the more yellow the paper made from the pulp).

Starting with a pulp that was 54 brightness and a 24.3 b* value we bleached it first with $11 per ton FAS at 85° C. and got a brightness of 72.2 and a b value of 8.7. Using HAS at a similar chemical cost per ton we achieved a 65 brightness and b*=15.8. Adding FAS to the HAS (1:1) gave some improvement compared to the HAS by itself, brightness=67.4 and b*=12.6, and when we added Alum to the combination (1:3:7, FAS/HAS/Alum) the brightness=69.4 and b*=10.7 improved again. However the best combination was with FAS/HAS and the initiator Dextrose (1:3:5) yielding a brightness of 72.6 and b*=8.4. This material is also a more stable chemical blend than 100% FAS and about a dollar per ton less expensive.

Example 6

A study comparing HAS to FAS at increased retention times using a different Mixed Office Waste Pulp from a commercial low lignin deinking process was conducted. HAS at 6 lbs per ton with FAS at 5 lbs was compared. These dosages were used to equalize chemical cost per ton processed. The following table shows the comparison.

| | Retention (min) | | | |
|---|---|---|---|---|
| | 0 | 60 | 120 | 360 |
| HAS L* | 86.3 | 90.2 | 90.4 | 90.4 |
| HAS b* | 5.9 | 4 | 3.9 | 4.5 |
| FAS L* | 86.3 | 90.3 | 90 | 88 |
| FAS b* | 5.9 | 3.4 | 4.1 | 6.8 |

After on hour retention FAS had better color stripping (b*) and brightness (L*), but after two hours and beyond the HAS is superior.

While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A process for bleaching substantially lignin-free pulp or paper in either a single-stage bleaching process or multi-stage reductive bleaching process; comprising contacting said substantially lignin-free pulp or paper with an aqueous reductive bleaching solution comprising hydroxymethane sulfinic acid during a reductive bleaching stage for sufficient amount of time at least partially to bleach said substantially lignin-free pulp or paper.

2. The process of claim 1 wherein said substantially lignin-free pulp is recycled waste paper.

3. The process of claim 1 wherein the amount of hydroxymethane sulfinic acid is from about 0.1 to about 40 pounds per ton (dry weight) of pulp or paper being treated.

4. The process of claim 1 wherein at least one second reductive bleaching agent simultaneously contacts the substantially lignin-free pulp or paper.

5. The process of claim 4 wherein the second reductive bleaching agent is selected from the group consisting of sodium hydrosulfite, formamidine sulfinic acid and mixtures thereof.

6. The process of claim 4 wherein the weight ratio of hydroxymethane sulfinic acid to the second reductive bleach is from about 1:20 to about 20:1.

7. The process of claim 4 wherein the amount of second reductive bleaching agent is from about 0.1 to about 40 pounds per ton (dry weight) of pulp or paper being treated.

8. The process of claim 1 wherein additionally at least one bleaching initiator is added to the aqueous solution of hydroxymethane sulfinic acid.

9. The process of claim 8 wherein said bleaching initiator is selected from the group consisting of one or more sugars, alum and mixtures thereof.

10. The process of claim 8 wherein the weight ratio of said bleaching initiator is from about 0.1 pound/ton of pulp to about 40 pounds/ton.

11. The process of claim wherein the aqueous reductive bleaching solution comprising hydroxymethane sulfinic acid is employed in at least one stage of multi-stage bleaching process.

12. The process of claim 1 wherein the hydroxysulfinic acid employed is a sodium salt.

13. The process of claim 1 wherein the contacting occurs at a temperature from about 50° C. to 110° C. for about 15 minutes to about 360 minutes.

* * * * *